US011920337B2

(12) United States Patent
Shahar et al.

(10) Patent No.: US 11,920,337 B2
(45) Date of Patent: Mar. 5, 2024

(54) AIR EXHAUST APPARATUS AND TOILET BOWL COMPRISING SAME

(71) Applicant: INVENT AIRCARE LTD., Gedera (IL)

(72) Inventors: Iehezkel Shahar, Gedera (IL); Tomer Shahar, Gedera (IL)

(73) Assignee: INVENT AIRCARE LTD., Gedera (IL)

( * ) Notice: Subject to any disclaimer, the term of this patent is extended or adjusted under 35 U.S.C. 154(b) by 46 days.

(21) Appl. No.: 17/616,286

(22) PCT Filed: Jun. 11, 2020

(86) PCT No.: PCT/IL2020/050644
§ 371 (c)(1),
(2) Date: Dec. 3, 2021

(87) PCT Pub. No.: WO2020/250225
PCT Pub. Date: Dec. 17, 2020

(65) Prior Publication Data

US 2022/0325514 A1 Oct. 13, 2022

(30) Foreign Application Priority Data

Jun. 11, 2019 (IL) ..... 267248

(51) Int. Cl.
*E03D 9/052* (2006.01)
*E03D 11/17* (2006.01)

(52) U.S. Cl.
CPC ..... *E03D 9/052* (2013.01); *E03D 11/17* (2013.01)

(58) Field of Classification Search
CPC ..... E03D 9/052; E03D 11/17; E03D 11/14; E03D 9/04; E03D 9/05; A47K 13/307
See application file for complete search history.

(56) References Cited

U.S. PATENT DOCUMENTS

| | | | | |
|---|---|---|---|---|
| 6,173,453 | B1 | 1/2001 | Shahar | |
| 8,196,232 | B2 * | 6/2012 | Van Herp | E03D 9/052 4/252.2 |
| 8,214,930 | B2 | 7/2012 | Azodi | |
| 2005/0028255 | A1 * | 2/2005 | Ma | E03D 9/05 4/216 |
| 2007/0169257 | A1 | 7/2007 | Van Herp | |
| 2009/0307831 | A1 * | 12/2009 | Shahar | E03D 9/052 29/401.1 |

(Continued)

FOREIGN PATENT DOCUMENTS

| | | | |
|---|---|---|---|
| CN | 1486382 | A | 3/2004 |
| DE | 29919800 | U1 | 2/2000 |

(Continued)

*Primary Examiner* — Janie M Loeppke
(74) *Attorney, Agent, or Firm* — Dorsey & Whitney LLP

(57) ABSTRACT

The present disclosure is directed to an air exhaust apparatus and a toilet bowl having an air exhaust apparatus, configured for propelling air from the toilet bowl towards a sewage line connecting the toilet bowl to the sewage system. In particular, the present disclosure aims at providing an internal exhaust system suitable for application with toilet bowls comprising a rinsing inlet and waste outlet for connecting the toilet bowl to a flush liquid source and the sewage line, respectively. The toilet bowl can be wall mounted or floor mounted.

20 Claims, 16 Drawing Sheets

(56) References Cited

U.S. PATENT DOCUMENTS

| | | | | |
|---|---|---|---|---|
| 2014/0090160 | A1 | 4/2014 | Myburgh | |
| 2015/0074886 | A1* | 3/2015 | Wu | E03D 9/052 4/213 |

FOREIGN PATENT DOCUMENTS

| | | | |
|---|---|---|---|
| DE | 10354540 | A1 | 6/2005 |
| DE | 202018100864 | U1 | 3/2018 |
| EP | 3179000 | B1 | 9/2020 |
| WO | 2005035886 | A1 | 4/2005 |
| WO | 2008039185 | A1 | 4/2008 |
| WO | 2018186541 | A1 | 10/2018 |

* cited by examiner

AIR EXHAUST APPARATUS AND TOILET BOWL COMPRISING SAME

TECHNOLOGICAL FIELD

The presently disclosed subject matter is related to an air exhaust apparatus, and in particular, an air exhaust apparatus for use in conjunction with a toilet bowl.

BACKGROUND

Mankind uses toilets and sewer systems for disposal of bodily wastes for many years. Ever since toilets first became available, various forms of toilets have been designed and currently there are numerous types of toilets around the world. However, although toilets are suitable for disposing of unwanted fluids or solids, most of them are not designed to deal with the gas that accompanies the disposal process, gas which, more often than not, contains non-pleasant odors.

In order to deal with the accompanying gases, external ventilation devices are at times installed in the vicinity of the toilets for exhausting the gas to the air outside of the building having the toilets within them. Such external ventilation may be expensive, unaesthetic, noise generating, and may limit the possible positioning of toilet rooms due to the pipeline required to connect the external ventilation to the exterior of the building.

GENERAL DESCRIPTION

The present disclosure is directed to an air exhaust apparatus and a toilet bowl having an air exhaust apparatus, configured for propelling air from the toilet bowl towards a sewage line connecting the toilet bowl to the sewage system. In particular, the present disclosure aims at providing an internal exhaust system suitable for application with toilet bowls comprising a rinsing inlet and waste outlet for connecting the toilet bowl to a flush liquid source and the sewage line, respectively. The toilet bowl can be wall mounted or floor mounted.

According to a first aspect of the invention there is disclosed an air exhaust apparatus for use in conjunction with a flush toilet system comprising a rinsing liquid source and a toilet bowl configured with a rinsing inlet and a waste outlet, the air exhaust apparatus comprises:

- a housing constituting a gas tight space,
- a flushing conduit extending through the housing and comprising a front portion couplable to said rinsing inlet, and a rear portion couplable to the rinsing liquid source; the flushing conduit is configured with a suction opening disposed within the space, said suction opening is fitted with a liquid flow prevention mechanism configured for preventing rinsing liquid from flowing into the space during rinsing liquid flow towards the toilet bowl through said flushing conduit;
- a waste conduit extending through the housing and comprising a front portion couplable to said waste outlet, and a rear portion couplable to a sewage line; the waste conduit is configured with a gas discharge port disposed within the space;
- a gas propelling unit disposed within the gas tight space and being in flow communication with the gas discharge port and configured to selectively propel gas in direction from the suction opening towards said gas discharge port; and

- a gas flow valve configured to selectively propel gas in a direction between the suction opening and the gas discharge port when the gas propelling unit is active.

According to a second aspect of the invention there is disclosed a toilet bowl for use in conjunction with a rinsing liquid source, said toilet bowl comprising:

- a toilet bowl comprising a rinsing inlet, a waste outlet and a designated space disposed at the rear portion thereof;
- an air exhaust apparatus integral with or integrated with said toilet bowl and placed within said designated space, the air exhaust apparatus can comprise:
- a housing constituting a gas tight space;
- a flushing conduit extending through the housing and comprising a front portion couplable to said rinsing inlet, and a rear portion couplable to the rinsing liquid source; the flushing conduit is configured with a suction opening disposed within the space, said suction opening is fitted with a liquid flow prevention mechanism configured for preventing rinsing liquid from flowing into the space during rinsing liquid flow towards the toilet bowl through said flushing conduit;
- a waste conduit extending through the housing and comprising a front portion coupled to the waste outlet, and a rear portion couplable to the sewage line; the waste conduit is configured with a gas discharge port disposed within the space;
- a gas propelling unit disposed within the space and being in flow communication with the gas discharge port and configured to selectively propel gas in direction from the suction opening towards said gas discharge port; and
- a gas flow valve configured to selectively propel gas in a direction between the suction opening and the gas discharge port when the gas propelling unit is active.

According to a third aspect of the invention there is disclosed a toilet bowl connectable to a rinsing liquid source and a sewage line, said toilet bowl comprising a front portion comprising a bowl, and a rear portion comprising a rinsing inlet, a waste outlet, and a designated space configured to accommodate an air exhaust apparatus; said air exhaust apparatus comprising a flushing conduit couplable between the rinsing liquid source and the rinsing inlet and a waste conduit couplable between the waste outlet and sewage line.

According to a particular configuration of any of the aspects of the disclosure, the gas propelling unit can be disposed within the space.

In general, the air exhaust apparatus according to the first and second aspects interconnects the rinsing liquid source to the rinsing inlet of the toilet bowl and the sewage line to the waste outlet of the toilet bowl, respectively. The air exhaust apparatus is configured to propel gas from the rinsing inlet of the toilet bowl towards the sewage line connected to the waste outlet. The air exhaust apparatus can be a standalone device for use in conjunction with a conventional flush toilet system, whereby the air exhaust apparatus interconnecting the conventional flush toilet system can be disposed at any location between the toilet bowl and both of the rinsing liquid source and the sewage line.

In a first example, the air exhaust apparatus can be connected to a rinsing liquid conduit coupled to a rinsing liquid source and to a portion of the sewage line, that extend from a front surface of a wall, such as in cases of a concealed flush tank. Alternatively, the air exhaust apparatus can be positioned at a rear surface of the wall and be connected to a portion of the rinsing liquid source and to a portion of the sewage line positioned at the rear side of wall, while the flush conduit and the waste conduit thereof can extend through the front side of the wall. The air exhaust apparatus can also interconnect the rinsing inlet and the waste outlet of the flush toilet system with the rinsing liquid source and the sewage line, respectively, in a spaced apart manner by additional conduits. However, it is preferable to position the air exhaust apparatus as close as possible and more preferably, directly to the rinsing inlet. In other cases, the air exhaust apparatus can be integral with or integrated with the toilet bowl.

It is one of the objects of the present disclosure to enable gases and accompanying odors originating from the toilet bowl to flow towards the sewage line, whereby the air exhaust apparatus of the presently disclosed subject matter is configured to selectively establish flow communication and propel gas in direction from the flushing conduit towards the waste conduit when the gas propelling unit is active. Also, the gas flow valve is configured to prevent gas flow therethrough when the gas propelling unit is not active by the gas flow valve thereof. Thus, the air exhaust apparatus is configured to constantly prevent gases from the sewage line from flowing therethrough towards the toilet bowl. Also, gases and odors originating from the sewage line and the space are obstructed from further flowing towards the toilet bowl from the waste conduit by a trapway built in the toilet bowl.

Flow communication of the gas propelling unit with the gas discharge port is configured such that gases propelled outwards from the space by the gas propelling unit are obstructed from flowing back to the space as long as the gas propelling unit is active.

The gas flow valve is configurable between a flow-permitting position and a flow preventing position, and wherein the gas flow valve is configured to be displaced towards the flow-permitting position when the gas propelling unit is active and be displaced towards the flow-preventing position when the gas propelling unit is not active. When the gas propelling unit is active, gases originating from the toilet bowl (e.g. gas accompanying bodily waste disposal process) flows unidirectionally through the air exhaust apparatus towards the sewage line, whereby gases arriving from the sewage line towards the waste conduit are obstructed (e.g. by the gas propelled towards the sewage line). When the gas propelling unit is active, the gases are propelled into the space from the toilet bowl. When the gas propelling unit is not active, gases and accompanying odors originating from the sewage line flows towards the toilet bowl and occupies the space, wherein the gases are obstructed from further flow towards the toilet bowl by the gas flow valve, which is at the flow-preventing position.

The gas flow valve can be a low pressure dependent check valve. When the gas propelling unit is active, low pressure is created in the space by the gas propelling unit, which in turn causes the gas flow valve to be displaced towards the flow-permitting position and enable gas flow therethrough in directed toward the space, and when the gas propelling unit is not active, the gas flow valve automatically assumes the flow-preventing position and prevent gas flow therethrough either from the space or towards the space.

In an example of the gas flow valve of the presently disclosed subject matter, the gas flow valve can comprise:

a valve housing defining a gas tight valve chamber therein in flow communication with the suction opening of the flushing conduit;

one or more retention sections, each comprising an inclined port wall having a chamber outlet passage disposed therein, the chamber outlet passage is configured to enable flow communication between the valve chamber and the space of the housing, and a sealing element disposed externally to each chamber outlet passage and having a surface area larger than a surface area of the chamber outlet passage, said sealing element is disposed within the retention section and is configured to be tiltingly displaceable within the retention section between a sealing position and a permissive position.

At the sealing position, the sealing element sealingly bears at least over the peripheral surroundings of the chamber outlet passage so as to prevent fluid passage therethrough. At the permissive position, the sealing element is at least partially spaced from the chamber outlet passage so as to enable fluid passage therethrough. The sealing position can be associated with the flow-preventing position of the gas flow valve, and the permissive position can be associated with the flow-permitting position of the gas flow valve. The sealing element can be normally at a sealing position.

The valve housing can be configured to encompass the entire circumference of the suction opening, such that gas flow is enabled between the space and the flushing conduit only via the valve chamber.

The sealing element can be configured to be displaced towards the permissive position by suction forces generated by the gas propelling unit. For example, when the gas propelling unit is active and the gas flow valve is at the sealing position, vacuum can be created inside the space, which applies suction forces on the sealing element and resulting in the displacement of the sealing element towards the permissive position. At the permissive position, the constant flow generated by the active gas propelling unit can cause the sealing element to maintain the permissive position thereof.

The sealing element can be displaced towards the sealing position by gravitational forces acting thereon. In some cases, the center of gravity of the sealing element is shifted towards the inclined port wall. Thus, upon deactivation of the gas propelling unit, the suction forces generated by the gas propelling unit ceases, resulting in the displacement of the sealing element towards the permissive position.

The air exhaust apparatus is configured to prevent rinsing liquid flow therethrough by the liquid flow prevention mechanism. The liquid flow prevention mechanism is configured for preventing rinsing liquid from flowing into the space during rinsing liquid flow towards the toilet bowl through said flushing conduit. In a first example of the presently disclosed subject matter, the liquid flow prevention mechanism is a liquid valve. The liquid valve which can be normally opened, is configured to sealingly cover the peripheral surroundings of the suction opening upon rinsing liquid flow through said flushing conduit, in an automated manner.

The liquid valve fitted in the flushing opening can comprise a flap member disposed within the flushing conduit in register with the suction opening. The flap member is configured with a sealing portion having a surface area larger than a surface area of the suction opening. The sealing portion is positioned at the upper surface of the flap member. The flap member is displaceable between a closed position, at which the sealing portion sealingly covers the suction opening so as to prevent rinsing liquid flow therethrough, and an open position at which the sealing portion is at least partially spaced from the suction opening so as to enable fluid passage therethrough.

When the rinsing liquid flows within the flushing conduit, the flap member can be displaced towards the closed position thereof by the pressure of the rinsing liquid that flows through the flushing conduit. For example, when the rinsing liquid flows in the flushing conduit, the rinsing liquid can apply pressure forces onto the flap member, resulting in the displacement of the flap member towards the closed position. When the rinsing liquid flow within the flushing conduit weakens, the flap member is configured to be displaced towards the open position thereof by gravitational forces acting thereon. For example, when the rinsing liquid flow in the flushing conduit weakens, the pressure forces applied by the rinsing liquid flow onto the flap member against the gravitational forces ceases, thus resulting in the displacement of the flap member towards the open position.

In a particular example of the presently disclosed subject matter, the flushing conduit can comprise a tapering portion disposed within the flushing conduit and in register with the suction opening thereof. The tapering portion, which tapers towards the front portion of the flushing conduit, can be configured to increase the pressure forces of the rinsing liquid flowing through said tapering portion. By reducing the internal diameter of the flushing conduit, the rinsing liquid pressure rises at the tapering portion, and the pressure forces applied on the bottom side of the flap member is increased. The increased pressure forces acting on the flap member are configured to strengthen the pressure forces displacing and maintaining the flap member at the open position, and to prolong the time in which the sealing portion of the flap member sealingly covers the suction opening.

In a second example of the presently disclosed subject matter, the liquid flow prevention mechanism can be formed as an elevated member fluidly connecting the suction opening with the gas flow valve and extending upwards from the suction opening of the flushing conduit to a height above a water level line of the rinsing liquid inside the rinsing liquid source. Since the rinsing liquid source and the elevated member are communicating vessels, rinsing liquid is prevented from flowing through the elevated member towards the spacing.

Any one or more of the following featured designs and configurations can be applied to any of the aspects of the present disclosure, separately or in combinations thereof:

- Each retention section can further comprise an external support wall spaced from the inclined port wall and connected thereto by a bottom shoulder extending below the chamber outlet passage.
- The bottom shoulder can be configured with an angular or rounded cross section that forms a slope from the support wall towards the inclined port wall.
- The support wall can incline towards the inclined port wall, and define an acute angle with a horizontal axis X extending parallel to the ground.
- The sealing element can have a wedge-like cross section.
- The sealing element can be supported within the retention section by one or more support arms, configured to reduce friction forces during the displacement of the sealing element within the retention section.
- The sealing element can comprise two support arms extending downwards from a bottom edge thereof and are configured with a smaller bottom edge than the bottom edge of the sealing element.
- The support arms can be configured with a cross section similar to the cross section of the bottom shoulder.
- The sealing element can be pivotally articulated within the retention section by a pivot axel disposed therein.
- A counter-tilt element can connect the support wall and the sealing element, wherein the counter-tilt element is configured to store energy upon displacement of the sealing element towards the permissive position and apply the energy onto the sealing element for displacing the sealing element towards the sealing position.
- The tapering portion tapers toward the front portion of the flushing conduit.
- In cases the liquid flow prevention mechanism is a liquid valve, the flap member of the liquid valve can comprise a rear edge connected to the flushing conduit rearwards to the suction opening. The flushing conduit can comprise an annular depression along the circumference thereof and rearwards to the suction opening, and the flap member can comprise a matching protrusion extending from a rear edge thereof positioned and secured inside the annular depression.
- The flap member can comprise a maintainer element configured to maintain the flap member at the normally open position. The maintainer element can be configured to increase the gravitational forces applied on the flap member so as to overcome any opposing forces acting on the flap member when the rinsing liquid ceases to flow and apply pressure forces thereon.
- The flap member can comprise a truncated conical shape.
- The flap member can be formed of a material that is durable in aqueous environment.
- The gas propelling unit can be disposed between the flushing conduit and the waste conduit.
- The flow communication of the gas propelling unit with the gas discharge port can be configured such that gases propelled outwards from the space by the gas propelling unit are obstructed from flowing back to the space as long as the gas propelling unit is active.
- The gas propelling unit can be configured to propel gas from the space into a gas inlet thereof and outwards from a gas outlet thereof when the gas propelling unit is active.
- A gas discharge member can be disposed between the gas outlet and the gas discharge port and wherein the gas discharge member is configured to facilitate direct gas flow therebetween.
- The air exhaust apparatus can further comprise a controller configured to activate and deactivate the gas propelling unit upon triggering actuation thereof.
- The controller can be configurable between an always operating mode, an actuation dependent mode and an off mode.
- The controller can comprise a lighting source for indicating the current mode thereof and/or to alert a user when the air exhaust apparatus requires maintenance.
- The controller can be configured to be actuated manually by a user or actuated in an automated manner
- The controller can be configured to deactivate the gas propelling unit when rinsing liquid flows in the flushing conduit.
- The flushing conduit and the waste conduit can extend normally through the housing.
- The flushing conduit and the waste conduit can be fixedly positioned relative to each other.
- The flushing conduit and the waste conduit can have their respective portions extending through the housing substantially parallel.
- The suction opening can be disposed at an upper portion of the flushing conduit.
- The gas discharge port can be disposed at an upper portion of the waste conduit.
- The gas discharge port can be fitted with a screening mesh for preventing particle material from entering the housing. In other examples, the screening mesh can be fitted, either integral with or integrated with, the rear portion of the waste conduit instead of the gas discharge port.

The gas discharge port can be fitted with a discharge pressure check valve.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
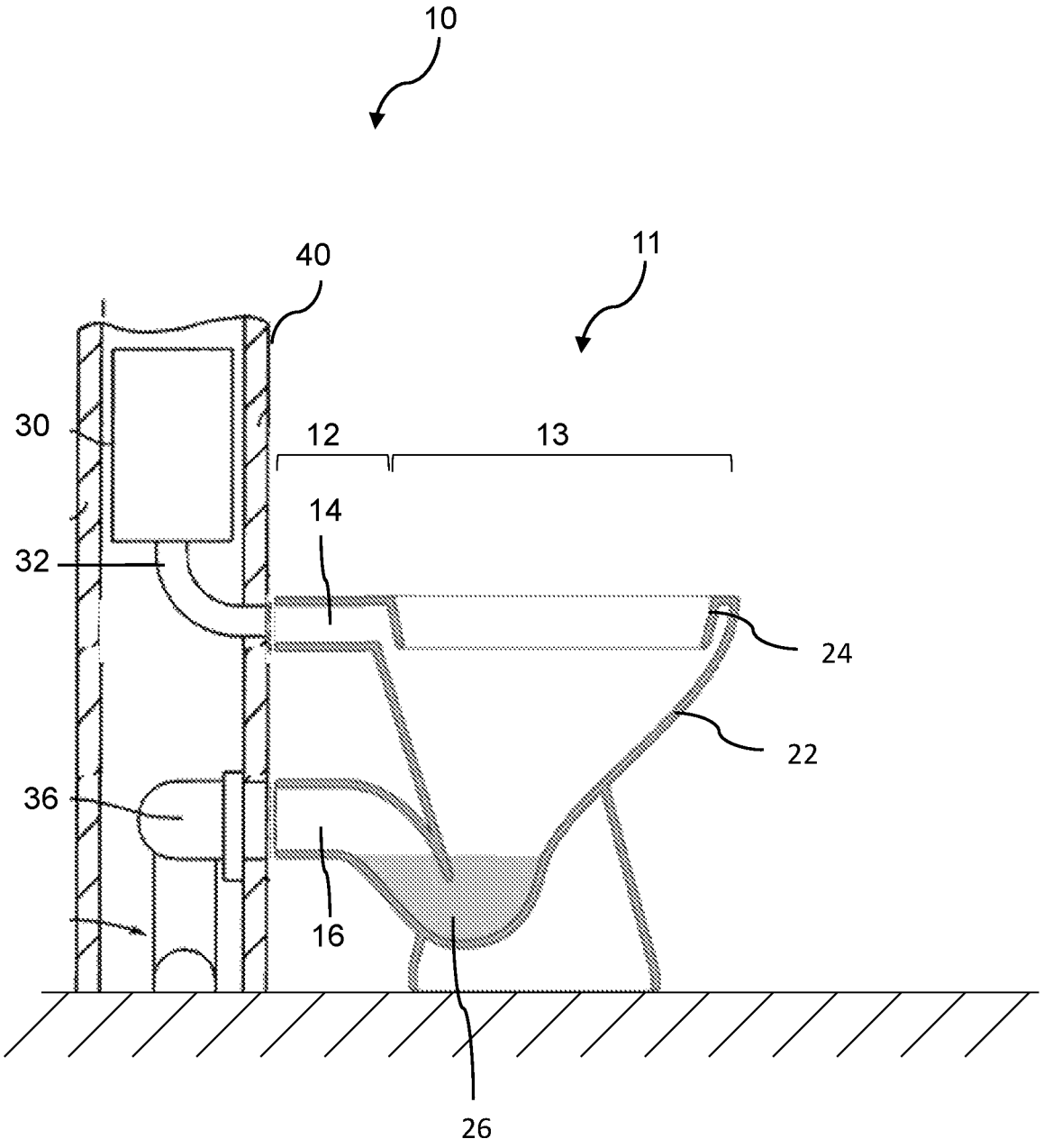
Fig. 1 (PRIOR ART)
FIG. 1 is a cross-sectional side view of a conventional flush toilet system.
Figure 2:
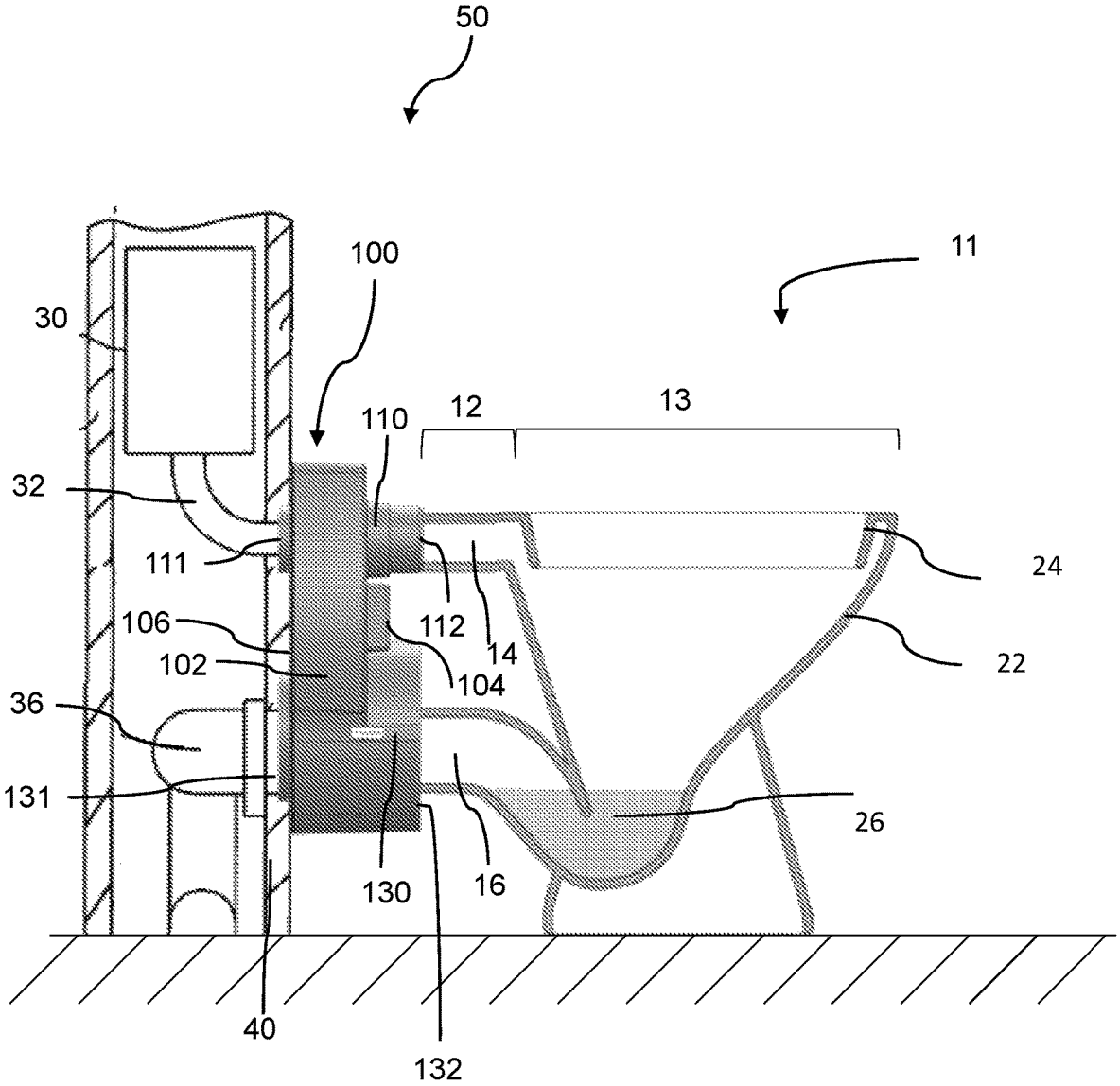
FIG. 2 illustrates a side view of an air exhaust apparatus used in conjunction with the conventional flush toilet system of FIG. 1, according to a first aspect of the presently disclosed subject matter.
Figure 3A:
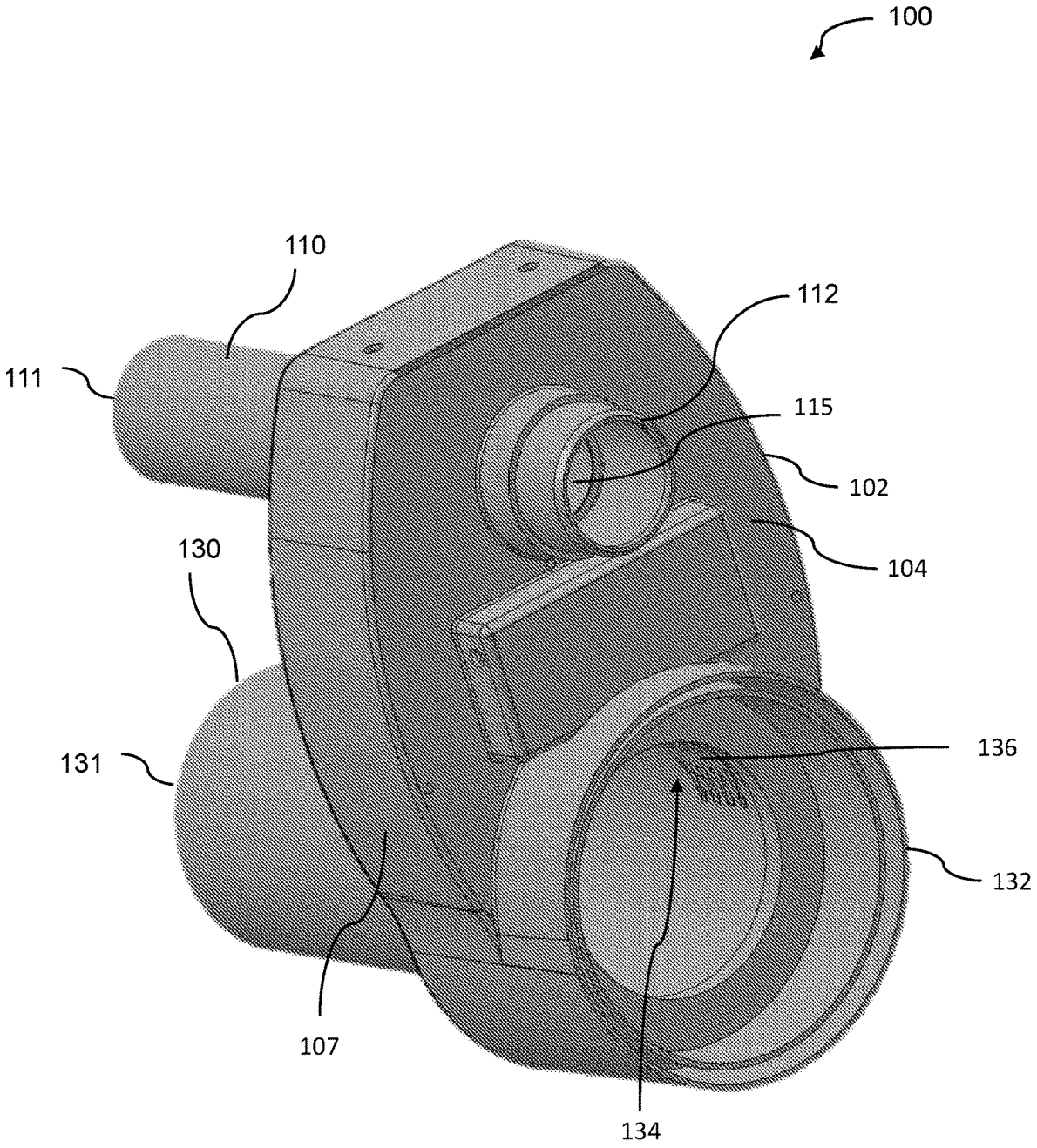
FIG. 3A illustrates a front perspective view of the air exhaust apparatus seen in FIG. 2A.
Figure 3B:
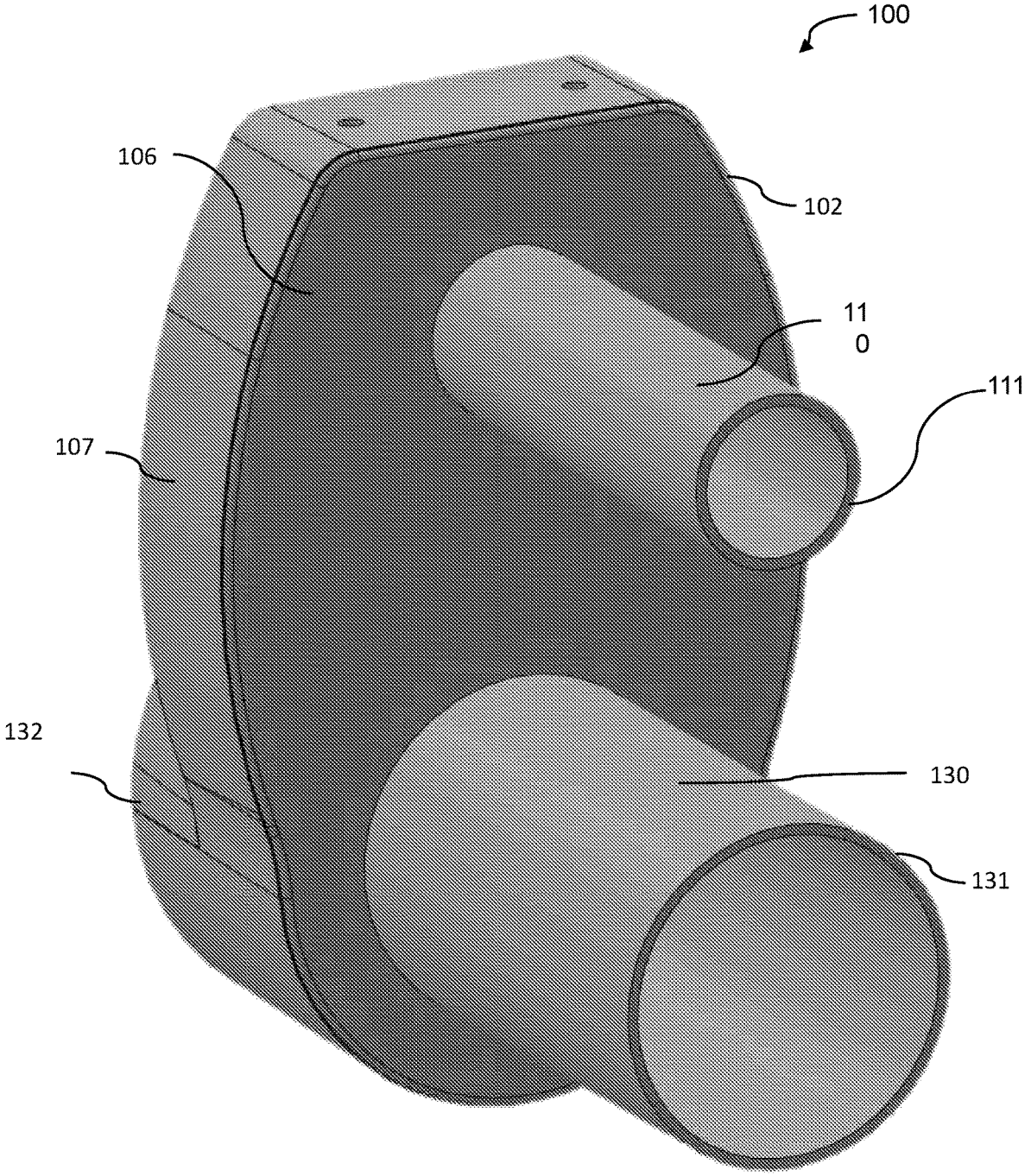
FIG. 3B illustrates a rear perspective view of the air exhaust apparatus of FIG. 3A.
Figure 3C:
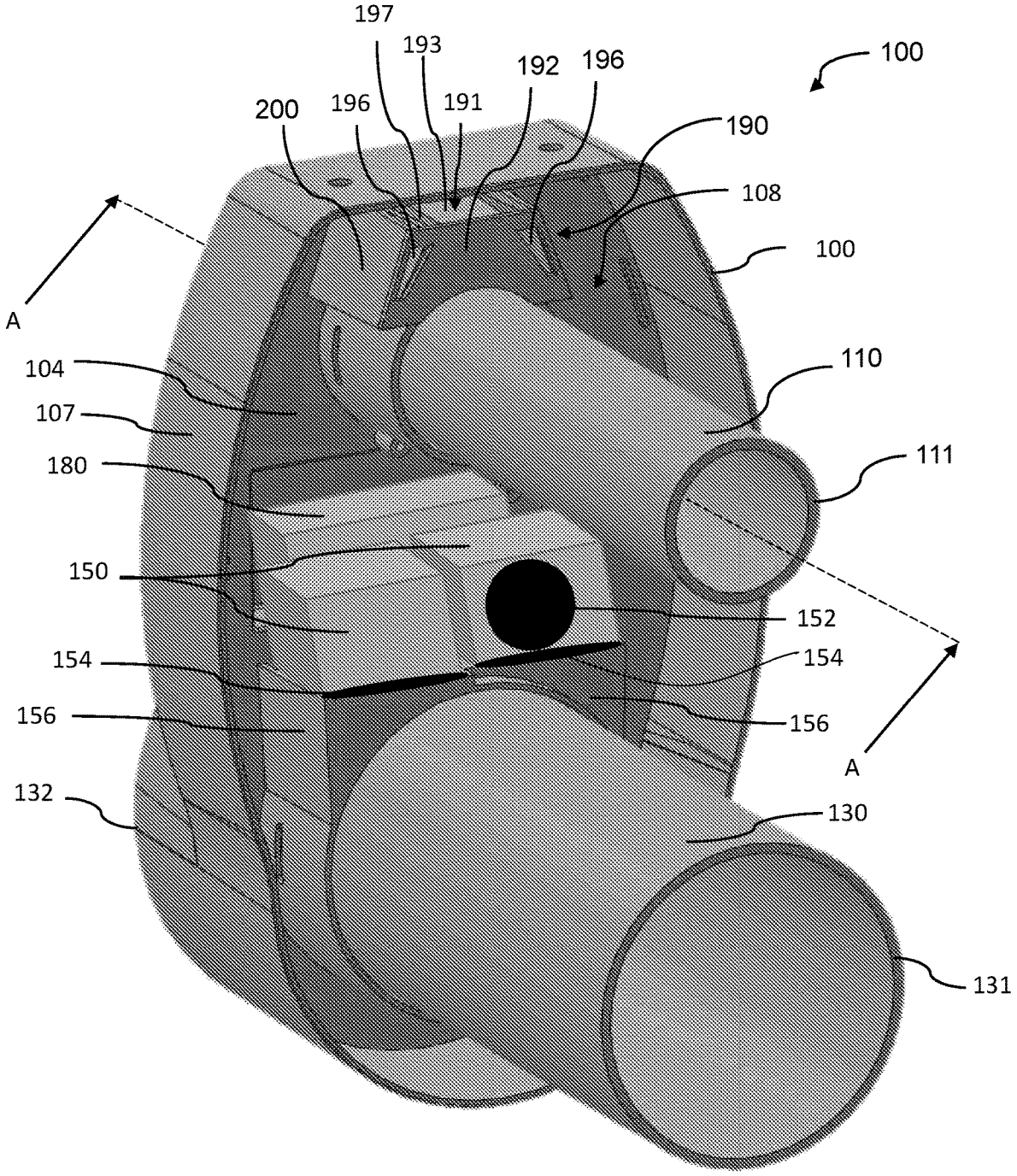
FIG. 3C illustrates the air exhaust apparatus of FIG. 3B, with a back cover removed for clarity.
Figure 3D:
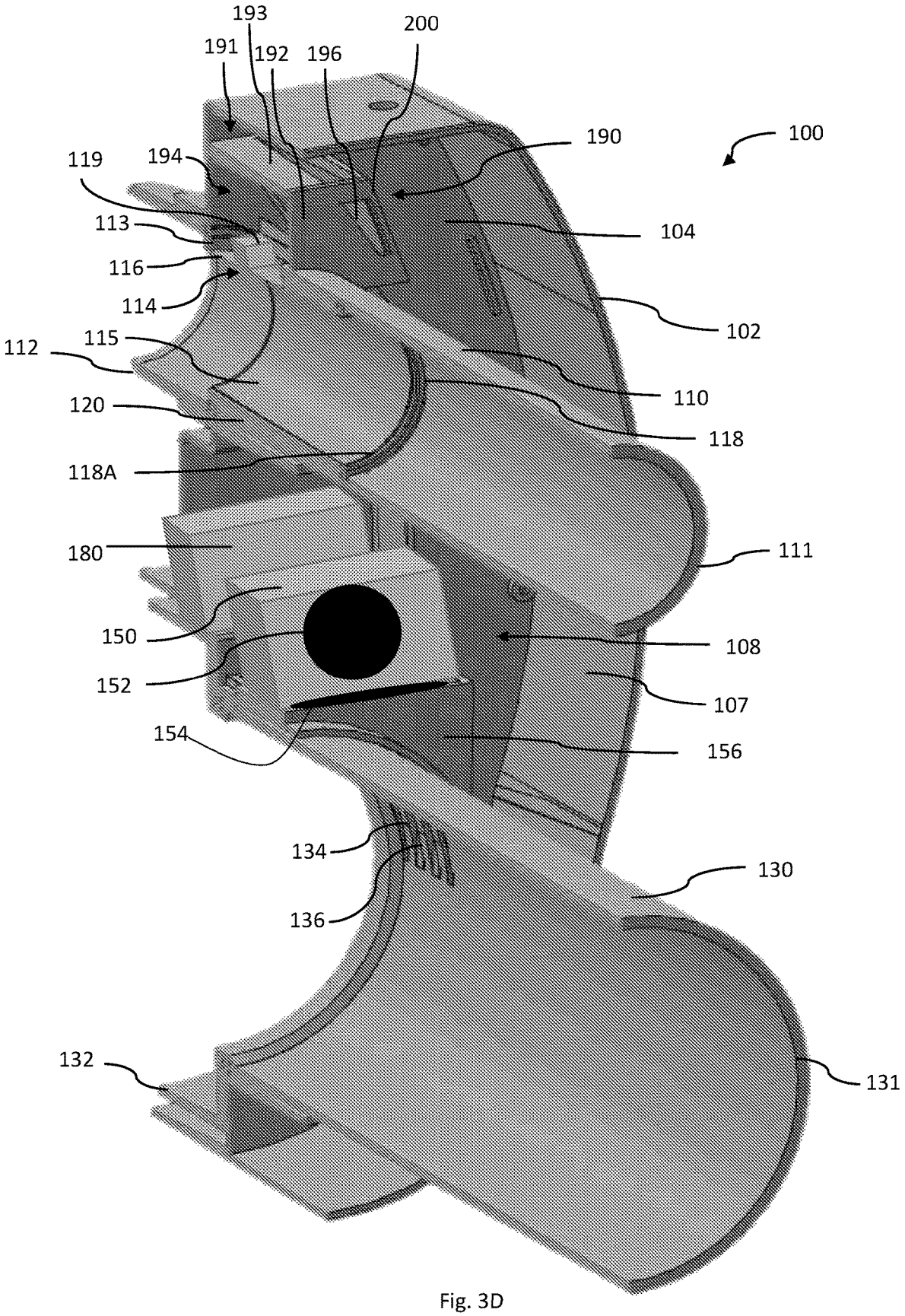
FIG. 3D is a cross-sectional view along line A-A in FIG. 3C.

FIG. 1 is a cross sectional view of a known in art flush toilet system 10 with a toilet bowl 11, a rinsing liquid source 30 and a sewage line 36. The toilet bowl 11 comprises a rear portion 12 and a front portion 13. The rear portion 12 of the toilet bowl 11 comprises a rinsing inlet 14 and a waste outlet 16, both facing the rear side of the toilet bowl 11. The front portion 13 comprises a bowl 22, a rinse dispensing portion 24 fluidly connected to the rinsing inlet 14 disposed at a top portion of the bowl 22, and a liquid trapway 26 fluidly connected to the waste outlet 16 located at a bottom portion of the bowl 22.

The rinsing liquid source 30 (e.g. a cistern, a liquid supply pipe) is provided with a rinsing liquid tube 32 extending therefrom. The rinsing liquid source 30 is configured to dispense rinsing liquid through the rinsing liquid tube 32 upon flushing action. As shown, the rinsing liquid source 30 is positioned behind a wall 40, with the rinsing liquid tube 32 extending through the wall 40 and from a front side of the wall 40. The sewage line 36 is provided at the front side of the wall 40, and is configured to receive and facilitate waste from the waste outlet 16 to a sewage system (not shown). As shown, the toilet bowl 11 is fluidly connected to the rinsing liquid source 30 through the rinsing liquid tube 32 via the rinsing inlet 14, and also fluidly connected to the sewage line 36 via the waste outlet 16.

Further reference is made to FIGS. 2 to 8, illustrating an air exhaust apparatus, generally designated 100 which together with the toilet bowl 11 and the rinsing liquid source 30 define a flush toilet system 50. The air exhaust apparatus 100 is configured for use in conjunction with the flush toilet system 10 of the type illustrated and disclosed in FIG. 1, and accordingly like reference numbers are used to designate like elements.

The air exhaust apparatus 100 comprises a housing 102 which is a box-like structure comprising a front cover 104, a rear cover 106 and a perimetric side wall 107, giving rise together to a gas tight space 108 disposed in-between. The front cover 104 is configured to face the rinsing inlet 14 and the waste outlet 16, and the rear cover 106 is configured to face the rinsing liquid tube 32 and the sewage line 36.

The air exhaust apparatus 100 comprises a flushing conduit 110 for interconnecting the rinsing liquid source 30 (via rinsing liquid tube 32) with the rinsing inlet 14, and a waste conduit 130 interconnecting the sewage line 36 with the waste outlet 16. Both of the flushing conduit 110 and the waste conduit 130 extend normally through the housing 102, are fixedly positioned relative to each other and having their respective portions extending through the housing 102 substantially parallel. As will become apparent hereinafter, the flushing conduit 110 and the waste conduit 130 are in flow communication by the space 108 of the housing 102 such that gases can be propelled via the housing from the flushing conduit 110 towards the waste conduit 130 and vice versa. As shown, the waste conduit 130 is configured with larger diameter than the flushing conduit 110, whereby the pressure of the rinsing liquid flow in the waste conduit 130 is reduced so as to prevent rinsing liquid from reaching the gas discharge port 134.

The flushing conduit 110 comprises a front portion 112 extending through the front cover 104 coupled to the rinsing inlet 14, and a rear portion 111 extending through the rear cover 106 coupled to the rinsing liquid tube 32 of the rinsing liquid source 30.

The flushing conduit 110 is configured with a suction opening 113 within the space 108, whereby the suction opening 113 is fluidly connecting the flushing conduit 110 with the space 108 of the housing 102. In the illustrated example, the flushing conduit 110 is positioned at the upper section of the flushing conduit 110. In other examples (not illustrated), the suction opening 113 can be positioned at other positions than the upper position of the flushing conduit 110. The suction opening 113 is fitted with a liquid flow prevention mechanism, which is configured to prevent rinsing liquid from flowing into the space 108 during rinsing liquid flow towards the toilet bowl 11 through said flushing conduit 110. In a first example of the disclosed subject matter, the liquid flow prevention mechanism is a liquid valve 114 (FIGS. 5A and 5B), configured for preventing rinsing liquid from flowing into the space 108 via the suction opening 113. The liquid valve 114, which is normally opened, is configured to sealingly cover the suction opening 113 upon flushing action, in an automated manner, resulting from the flow of the rinsing liquid, as will be explained in greater detail hereinafter.

In the presently disclosed subject matter, the liquid valve 114 comprises a resilient flap member 115 disposed within the flushing conduit 110. The flap member 115 is configured with a sealing portion 116 in register with the suction opening 113 and having a surface area larger than a surface area of the suction opening 113. The flap member 115 is displaceable between a closed position (FIGS. 5A and 6), at which the sealing portion 116 sealingly covers the suction opening 113 so as to prevent rinsing liquid flow therethrough, and an open position (FIGS. 5B, 7 and 8) at which the sealing portion 116 is at least partially spaced from the suction opening 113, so as to enable fluid passage therethrough. The flap member 115 is configured to be displaced towards the closed position thereof by the pressure forces applied by the rinsing liquid that flows through the flushing conduit, and is configured to be displaced towards the open position thereof by gravitational forces acting thereon.

The flap member 115 can be connected to the flushing conduit 110 in a plurality of methods. In the illustrated example of the presently disclosed subject matter, the flushing conduit 110 comprises an annular depression 118 (FIG. 3D) along the circumference thereof rearwards to the suction opening 113. The flap member 115 comprises a matching protrusion 118A extending from a rear edge thereof positioned and secured inside the annular depression 118. In the example of the presently disclosed subject matter, the flap member 115 is formed of a material that is durable in aqueous environment. The flap member 115 is thin and may be formed as a single material layer or a few layers formed from a plurality of material. The flap member 115 is formed of an elastic material such as rubber or silicone, or rigid materials such as a stainless-steel leaf. The flap member 115 have a shape conforming to the shape of the suction opening 113, and in further examples to the shape of the flushing conduit 110. In the illustrated example of the disclosed subject matter, the flap member 115 has a truncated conical shape.

In the example of the presently disclosed subject matter, the flap member 115 comprises a maintainer element 119. The maintainer element 119 is a mass disposed on the flap member 115 and configured to maintain the flap member 115 at the normally open position by increasing the gravitational forces applied on the flap member 115. The maintainer element 119 is configured to increase the gravitational forces applied on the flap member 115 so as to overcome any opposing forces acting on the flap member 115 (as will be further discussed hereinbelow), when the rinsing liquid ceases to flow and apply pressure forces thereon. The maintainer element is disposed on the sealing portion 116 and is configured to minimally interfere with the displacement of the flap member 115 towards the closed position. According to other examples (not illustrated) the maintainer element can be a biasing member, e.g. a spring.

In a particular example of the presently disclosed subject matter, the flushing conduit 110 has a tapering portion 120 in register with the suction opening 113. As shown, the tapering portion 120 is disposed within the flushing conduit 110 and tapers toward the front portion 112 of the flushing conduit 110 at least below the suction opening 113. In the illustrated example, the tapering portion 120 is integral with the flushing conduit 110. In other examples (not illustrated) the tapering portion 120 can be integrated with the flushing conduit 110 as an insert fitted therein.

The waste conduit 130 of the air exhaust apparatus 100 has a front portion 132 extending through the front cover 104 coupled to the waste outlet 16, and a rear portion 131 extending through the rear cover 106 coupled to the sewage line 36. The waste conduit 130 is configured with a gas discharge port 134 positioned at an upper portion of the waste conduit 130 and disposed within the space 108, whereby the gas discharge port 134 fluidly connecting the waste conduit 130 with the space 108 of the housing 102. The gas discharge port 134 is fitted with a screening mesh 136, configured for preventing particulate material from entering the space 108 therethrough. Such particulate material can include, for example, sewage dwellers such as rats or bugs originating from the sewage system. In other examples (not illustrated) the screening mesh 136 can be fitted, either integral with or integrated with, the rear portion 131 of the waste conduit 130 instead of the gas discharge port 134.

The air exhaust apparatus 100 further comprises a gas propelling unit 150 disposed within the space 108. The gas propelling unit 150 according to a particular example is a fan-type gas blower, configured to propel gas from the space 108 into a gas inlet 152 thereof and outwards from a gas outlet 154 thereof when the gas propelling unit 150 is active. The gas propelling unit 150 is disposed between the flushing conduit 110 and the waste conduit 130. The gas outlet 154 is configured to propel gases therefrom towards the gas discharge port 134. The air exhaust apparatus 100 is configured such that gases propelled outwards from the gas outlet 154 are isolated from the gases positioned within the space 108.

A gas discharge member 156 is disposed between the gas outlet 154 and the gas discharge port 134 and facilitates direct gas flow therebetween. It is appreciated that the gas propelling unit 150 can comprise more than one gas propelling unit.

In another example (not illustrated) the gas propelling unit 150 can be configured to prevent gas flow therethrough when not active. In yet another example (not illustrated), a discharge pressure check valve can be fitted at the gas discharge port 134, and is configured to enable gas flow in direction from the gas discharge port 134 towards the waste conduit 130 only when the gas pressure between the gas outlet 154 and the discharge pressure check valve rises (i.e. the gas propelling unit is active).

In the example of the presently disclosed subject matter, the air exhaust apparatus 100 further comprises a controller 180 configured to activate and deactivate the gas propelling unit 150 upon triggering actuation thereof. In the illustrated example, the controller 180 is located within the space 108 and is electrically connected to the gas propelling unit 150. In other examples (not illustrated) the controller 180 can be positioned elsewhere and be in an electronic communication (either wired or wireless) with the gas propelling unit 150. The controller 180 can be configured to be actuated manually by a user or actuated in an automated manner. For example, the automated manner for triggering actuation of the controller 180 comprises receiving input from one or more sensors (e.g. proximity sensor) that are configured to detect a presence of a user or a presence of rancid gases inside the toilet bowl 11.

The controller 180 is also configured to be actuated manually by a user or actuated in an automated manner for deactivating the gas propelling unit 150. For example, the automated manner for triggering actuation of the controller 180 comprises receiving input from one or more sensors (e.g. proximity sensor) that are configured to detect lack of presence of a user. Alternatively, a timer with a predetermined duration can be activated upon actuation of the controller 180 such that when the timer finishes the gas propelling unit 150 is turned off.

The controller is configurable between an always operating mode, at which the gas propelling unit 150 is active, actuation dependent mode, at which the gas propelling unit 150 is activated and deactivated in response to triggering actuation of the controller 180, and an off mode, at which the gas propelling unit 150 is not active.

In a possible example of the presently disclosed subject matter, the controller 180 can be configured to deactivate the gas propelling unit 150 when the flap member 115 is at a closed position. In other examples (not illustrated), the controller 180 can be electrically communicating with a lighting source and be configured to activate the gas propelling unit 150 when the lighting source is turned on and deactivate the gas propelling unit 150 when the lighting source is turned off.

Figure 4A:
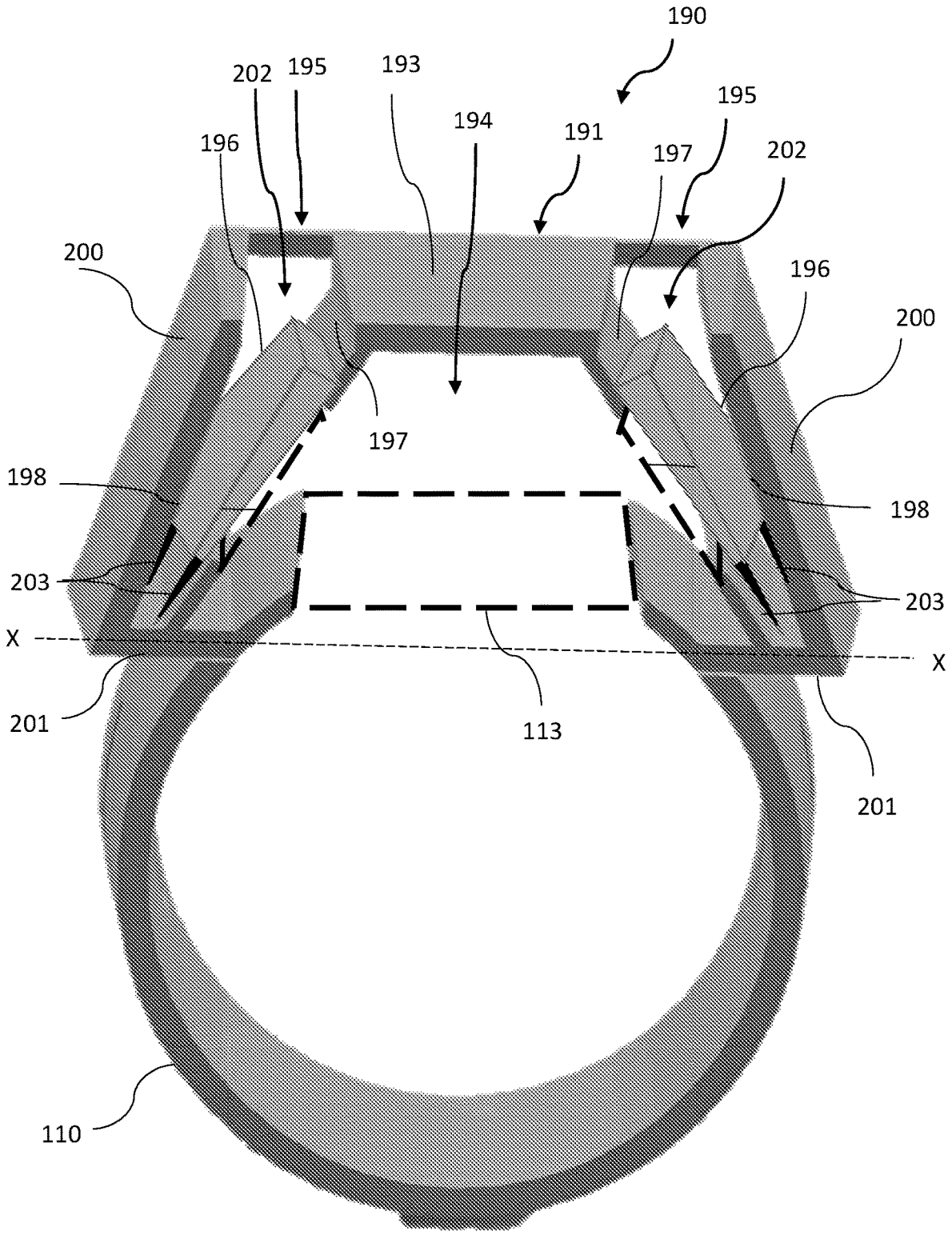
FIG. 4A illustrates a front perspective view of a gas flow valve of an air exhaust apparatus seen in FIG. 2A, at a flow-preventing position.
Figure 4B:
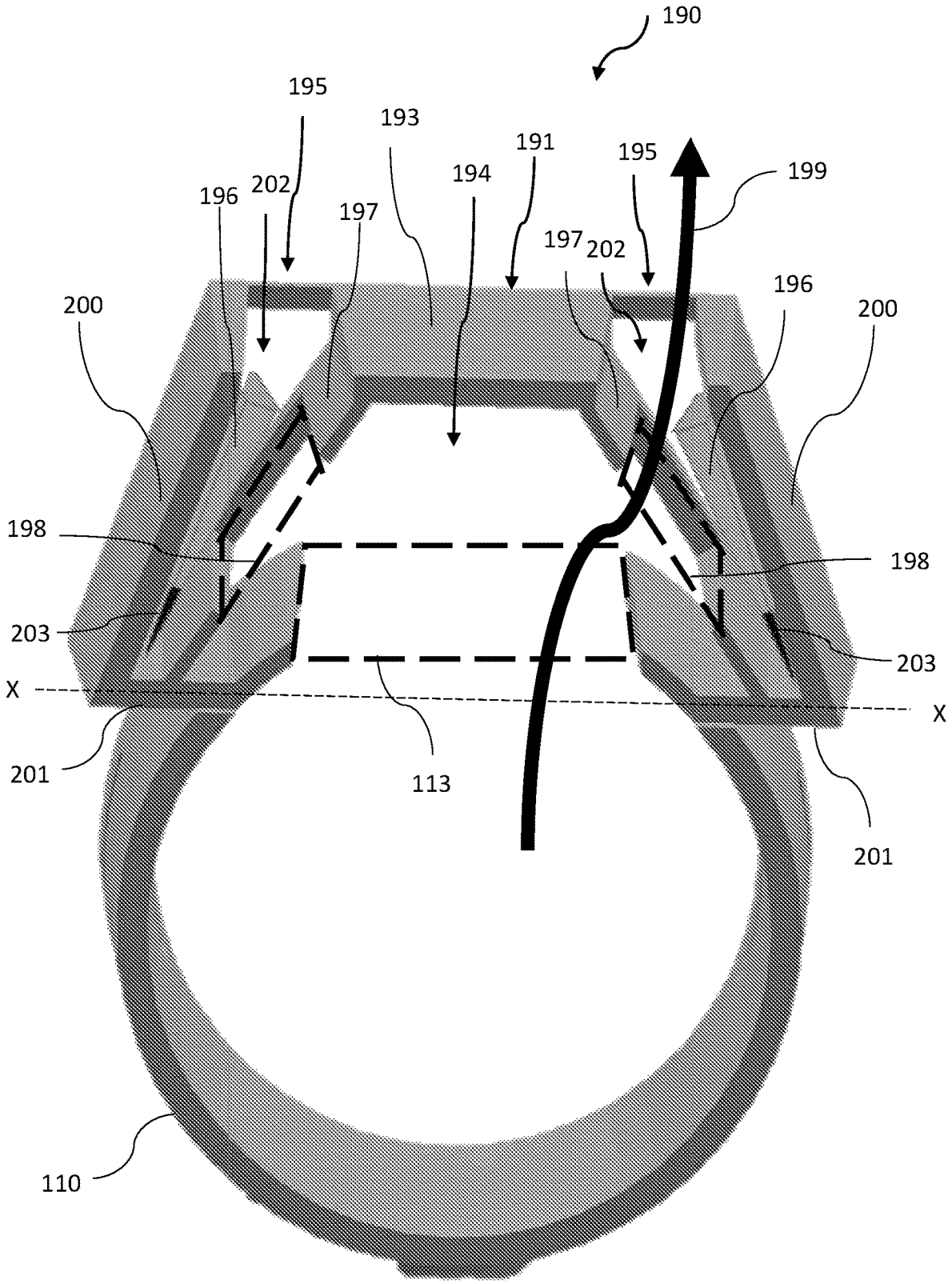
FIG. 4B illustrates a front perspective view of a gas flow valve of an air exhaust apparatus seen in FIG. 2A, at a flow-permissive position.
Figure 4C:
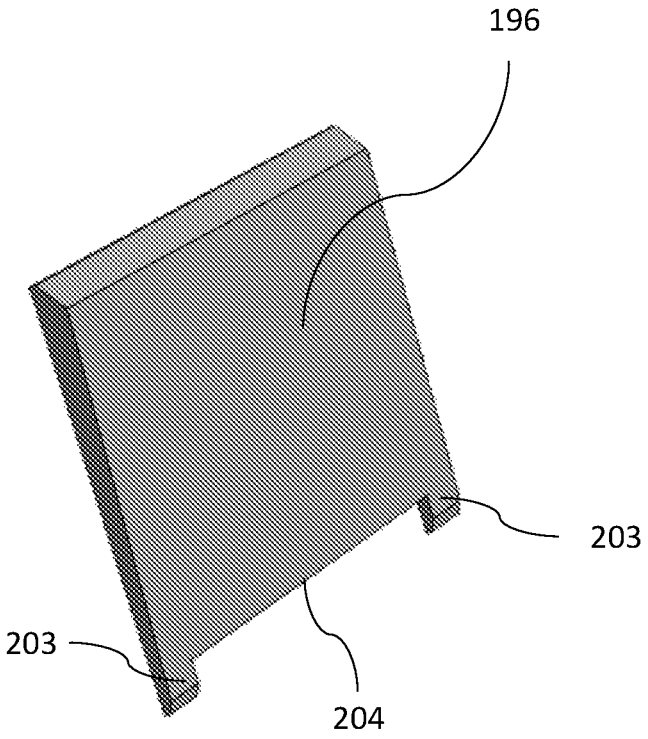
FIG. 4C is a perspective view of a sealing element of the gas flow valve of FIG. 4A.
Figure 5A:
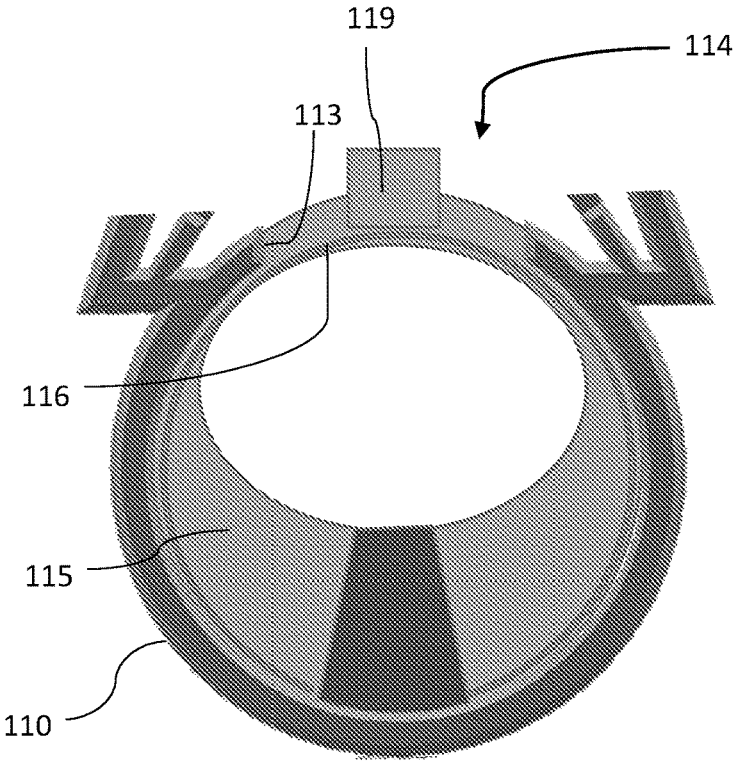
FIG. 5A illustrates a front perspective view of a liquid valve of an air exhaust apparatus seen in FIG. 2A, with a flap member thereof at a closed position.
Figure 5B:
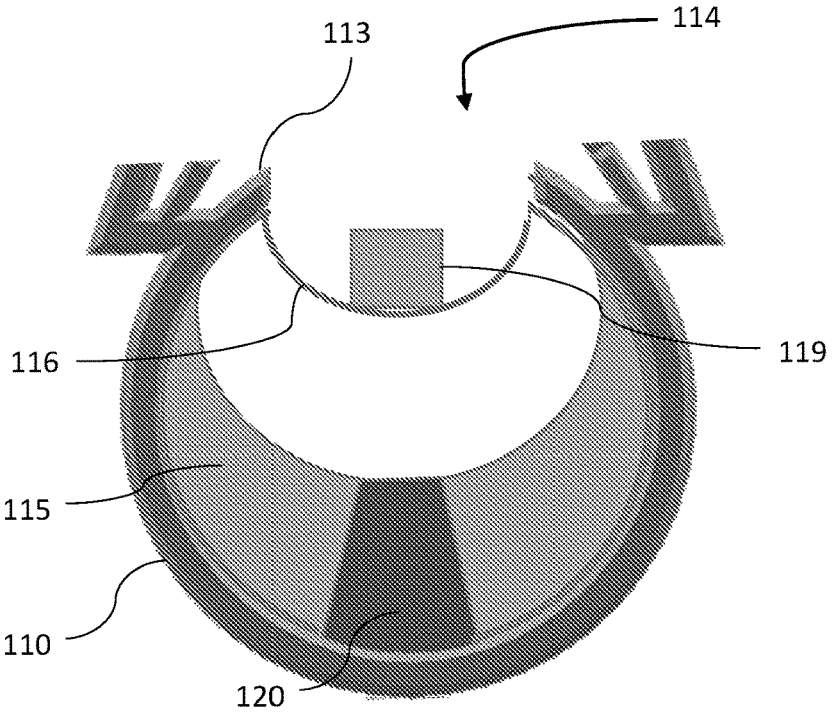
FIG. 5B illustrates a front perspective view of the liquid valve of an air exhaust apparatus seen in FIG. 2A, with a flap member thereof at an open position.

The air exhaust apparatus 100 further comprises a gas flow valve 190 configured to selectively enable gases to flow therethrough in direction from the suction opening 113 towards the space 108 (FIGS. 4A-4C). The gas flow valve 190 is configurable between a flow-permitting position and a flow preventing position. The gas flow valve 190 is positioned within the space 108 and above the upper portion of the flushing conduit 110 in register with the suction opening 113. The gas flow valve 190 comprises a valve housing 191 having a housing wall 192 with a top cover 193, giving rise together with the flushing conduit 110 to a gas tight valve chamber 194. The valve chamber 194 is in flow communication with the flushing conduit 110 through the suction opening 113. As shown, the housing wall 192 of the valve housing 191 encompasses the entire circumference of the suction opening 113 on top of the flushing conduit 110 such that gas flow is enabled between the space 108 and the flushing conduit 110 only via the valve chamber 194.

The gas flow valve 190 further comprises two retention sections 195. Each retention section 195 comprises an inclined port wall 197 having a chamber outlet passage 198 disposed therein for enabling flow communication between the valve chamber 194 and the space 108 of the housing 102. Each retention section 195 further comprises an external support wall 200 spaced from the inclined port wall 197 and connected thereto by a bottom shoulder 201 extending below the chamber outlet passage 198. The inclined port wall 197, the support wall 200 and the bottom shoulder 201 define together a confining space 202 therebetween. Each retention section 195 is configured with a wedge-like sealing element 196 confined within the confining space 202. The confining space 202 is also wedge-shaped and is configured with a cross section slightly wider than the cross section of the sealing element 196 for restricting the freedom of movement of the sealing element 196 confined therein. The bottom shoulder 201 is configured to serve as a fulcrum for the tilting displacement of the sealing element 196, as will be explained in greater detail hereinafter.

The sealing element 196 is configured with a surface area larger than a surface area of the chamber outlet passage 198. The sealing element 196 is tiltingly displaceable in the confining space 202 between a normal sealing position (FIG. 4A), and a permissive position (FIG. 4B). At the sealing position, the sealing element 196 sealingly bears at least over the peripheral surroundings of the chamber outlet passage 198 so as to prevent fluid passage therethrough. In some examples (not illustrated), the bottom shoulder 201 can be configured with an angular or rounded cross section that forms a slope from the support wall 200 towards the inclined port wall 197. The angular or rounded cross section that forms a slope can reduce friction forces during the tilting displacement thereof. In such examples, the bottom shoulder 201 causes the sealing element 196 to be displaced towards the inclined port wall 197 and be engaged over the peripheral surroundings of the inclined port wall 197. Sealing engagement with the inclined port wall 197 prevents fluid passage through the chamber outlet passage 198 which might occur in cases the sealing element 196 is not bearded properly against the chamber outlet passage 198 of the inclined port wall 197.

At the permissive position, the sealing element 196 is at least partially spaced from the chamber outlet passage 198 so as to enable fluid passage therethrough, in direction of arrow 199. The sealing element 196 is configured to be displaced towards the permissive position by suction forces applied thereon by the gas propelling unit 150. The gas propelling unit 150 is configured to generate the suction forces in the space 108 when the gas propelling unit 150 is active. The suction forces generated by the gas propelling unit 150 are configured to displace the sealing element 196 in direction from the sealing position thereof towards the permissive position thereof. The suction forces are also configured to maintain the sealing element 196 at the permissive position as long as the gas propelling unit 150 is active.

When the gas propelling unit 150 is not active, the sealing element 196 is configured to be displaced towards the sealing position. In accordance with the presently disclosed subject matter, the sealing element 196 is configured to be displaced towards the sealing position in an automated manner by gravitational forces. In a particular example of the presently disclosed subject matter, the support wall 200 inclines towards the inclined port wall 197 so as to define an acute angle with a horizontal axis X extending parallel to the ground. Thus, the sealing element 196 remains tilted toward the inclined port wall 197 also at the permissive position thereof, whereby deactivation of the gas propelling unit 150 results in a spontaneous displacement towards the sealing position by gravitational forces only.

In another example (not illustrated), a counter-tilt element can be configured to add biasing force to the sealing element 196, upon displacement thereof from the sealing position. In yet another example (not illustrated), the sealing element 196 can be pivotally articulated at the confining space 202 through a pivot axel. In such example, the sealing element 196 can be pivotally displaceable about the pivot axel between the sealing position thereof and the permissive position thereof.

In an example of the presently disclosed subject matter, the sealing element 196 is supported within the retention section 195 by one or more support arms 203, whereby the one or more support arms 203 are configured to reduce friction forces during the tilting displacement thereof. In the illustrated example, the sealing element 196 comprises two support arms 203 extending downwards from a bottom edge 204 of the sealing element 196. In some cases, the bottom edge 204 of the two support arms 203 is configured with a matching cross section to the cross section of the bottom shoulder 201. In other examples (not illustrated), the one or more support arms 203 can extend upwards from the bottom shoulder 201 or extend laterally from the inclined port wall 197 or the support wall 200.

Figure 6:
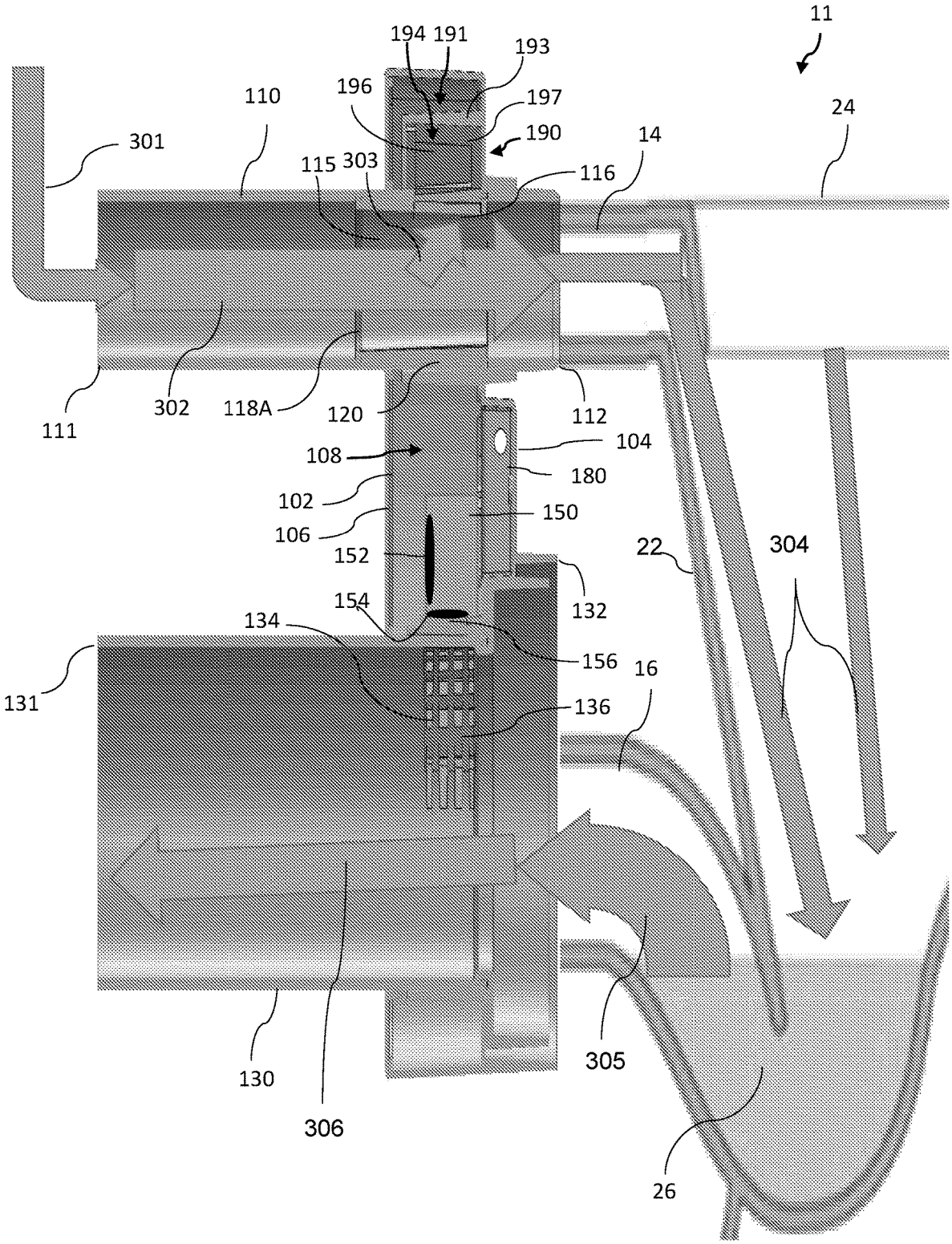
FIG. 6 is a cross-sectional side view along line A-A in FIG. 3C, with illustrations depicting the flow path of rinsing liquid flow through the air exhaust apparatus.

FIG. 6 illustrates the flow path in which the rinsing liquid flows through the flushing conduit 110 to the toilet bowl 11, and from the toilet bowl 11 to the sewage line 36. Upon flushing the toilet, rinsing liquid flows from the rinsing liquid source 30, through the rinsing liquid tube 32 and into the flushing conduit 110 (arrow 301). The rinsing liquid flows along the length of the flushing conduit 110 (arrow 302), and applies pressure forces onto the flap member 115 (arrow 303). The pressure forces applied by the rinsing liquid flow displaces the flap member 115 towards the closed position thereof (i.e. by displacing the sealing portion 116 against the suction opening 113 to sealingly cover the suction opening 113).

Then, the rinsing liquid flows through the rinsing inlet 14 and into the bowl 22 via the rinse dispensing portion 24 (arrows 304). The rinsing liquid further flows through the liquid trapway 26 and out from the waste outlet 16 (arrow 305). Then, the rinsing liquid flows through the length of the waste conduit 130 into the sewage line 36 (arrow 306).

Figure 7:
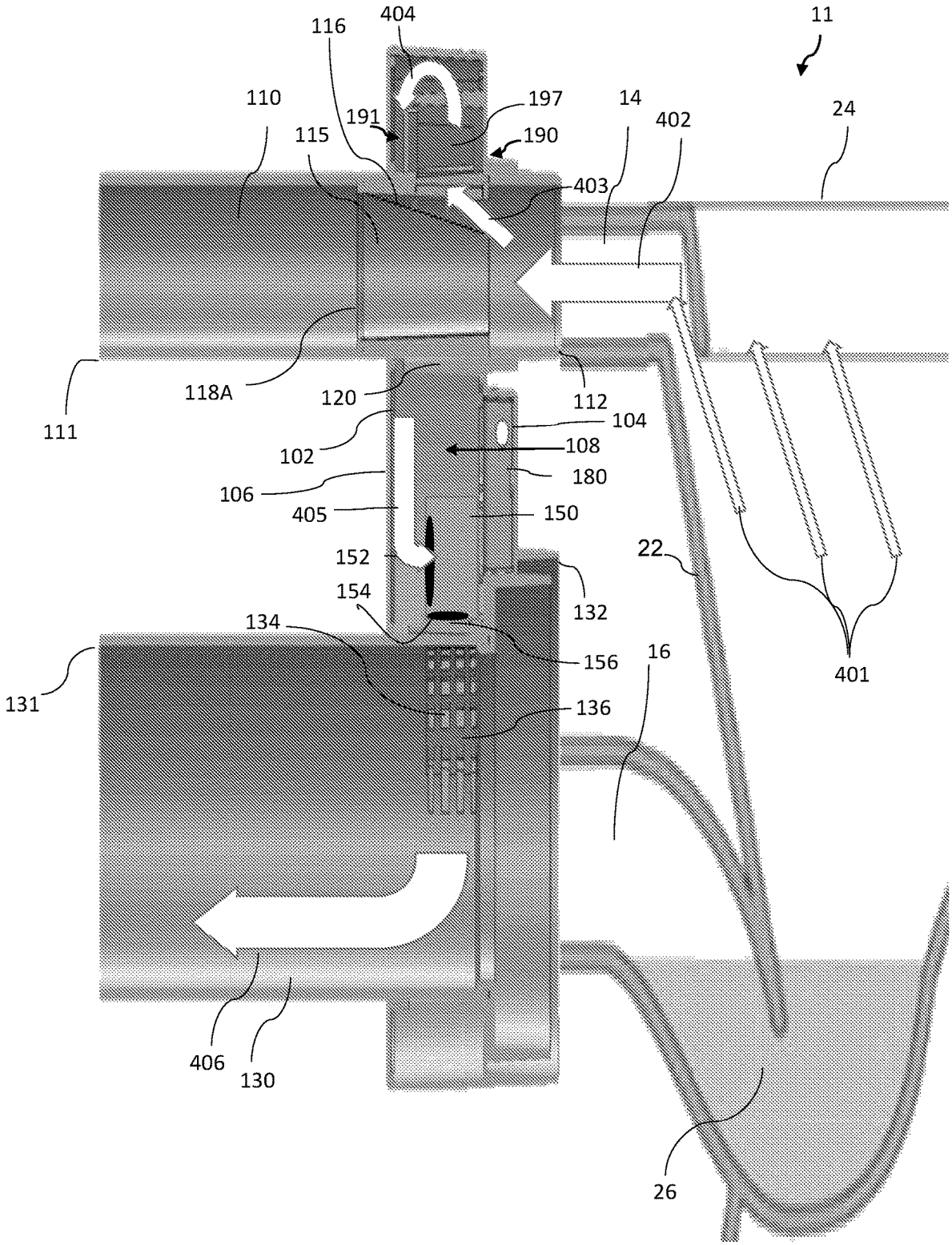
FIG. 7 is a cross-sectional side view along line A-A in FIG. 3C, with illustrations depicting the flow path of gas flow inside the air exhaust apparatus when the gas propelling unit is active.

FIG. 7 illustrates the flow path of gases originating from the toilet bowl 11 towards the sewage line 36 when the gas propelling unit 150 is active (i.e. generates suction forces inside the space 108). As shown, gases are propelled from the bowl 22 (arrows 401) and into the flushing conduit 110 via the rinsing inlet 14 (arrow 402). Then, the gases flow through the liquid valve 114 (at which case the flap member 115 thereof is at the open position) and through the suction opening 113 (arrow 403). Then, the gases are further propelled through the gas flow valve 190, which is at the flow-permitting position, into the space 108 (arrow 404). Inside the space 108, the gases are propelled towards the gas inlet 152 (arrow 405) and outwards from the gas outlet 154 into the gas discharge member 156. Then, the gases are propelled out from the gas discharge port 134 and into the waste conduit 130 (arrow 406). At the waste conduit 130, gases are obstructed from flowing towards the toilet bowl 11 via the waste outlet 16 by the liquid trapway 26, and thus, the gases are propelled towards the sewage system via the sewage line 36.

Figure 8:
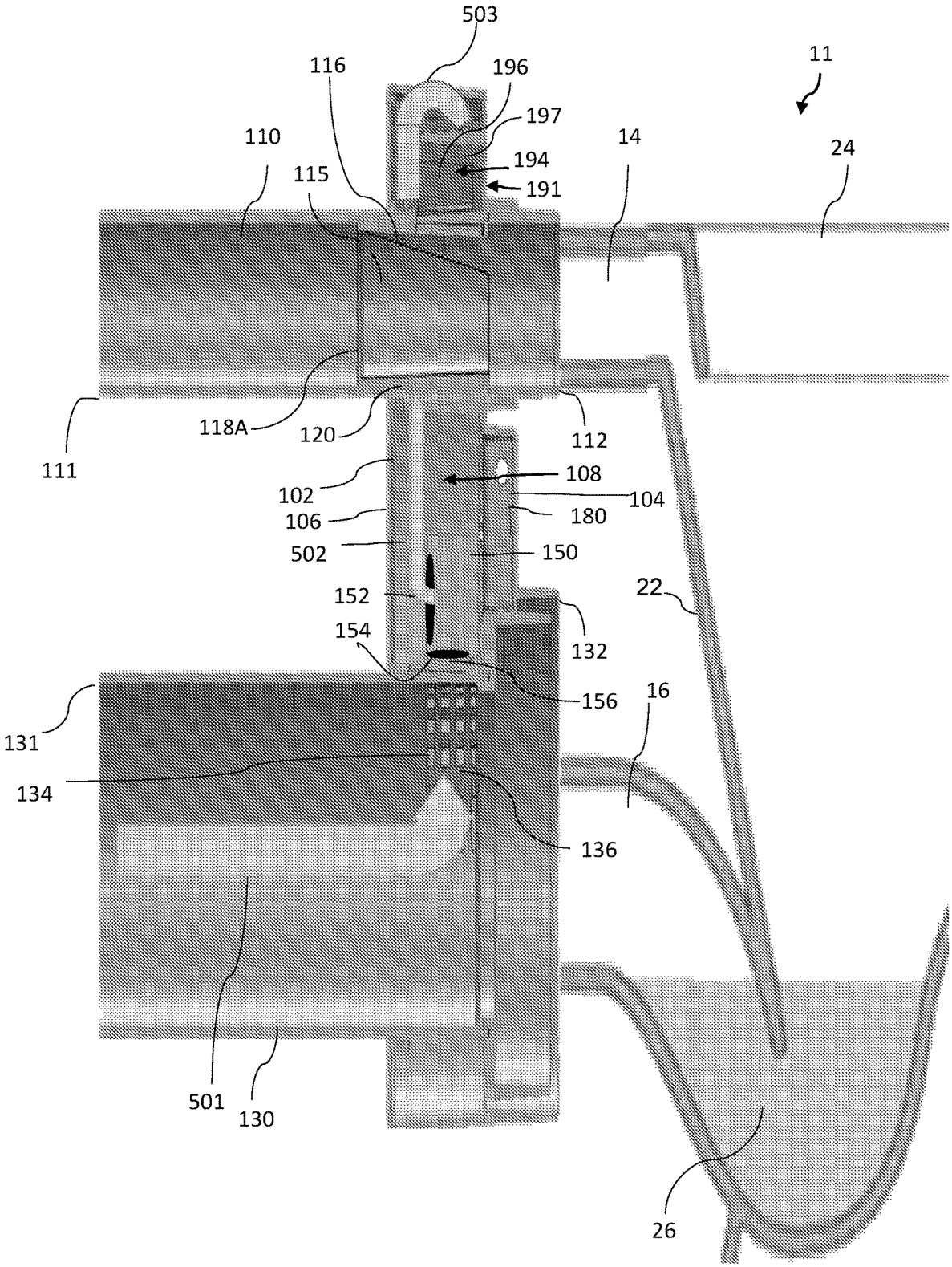
FIG. 8 is a cross-sectional side view along line A-A in FIG. 3C, with illustrations depicting the flow path of gas flow inside the air exhaust apparatus when the gas propelling unit is not active.

FIG. 8 illustrates the flow path of gases originating from the sewage line 36 towards the toilet bowl 11 when the gas propelling unit 150 is not active. As shown, the sewage gases flow from the sewage line 36 into the waste conduit 130 (arrow 501). Then, the gases flow out from the gas inlet 152 into the space 108 (arrow 502). The gases further flow towards the gas flow valve 190 (at which case is at the flow-preventive position thereof). At the gas flow valve 190, the gases are obstructed from further flow via the chamber outlet passage 198 to the flushing conduit 110 by the sealing element 196, which is at the sealing position thereof.

Figure 9:
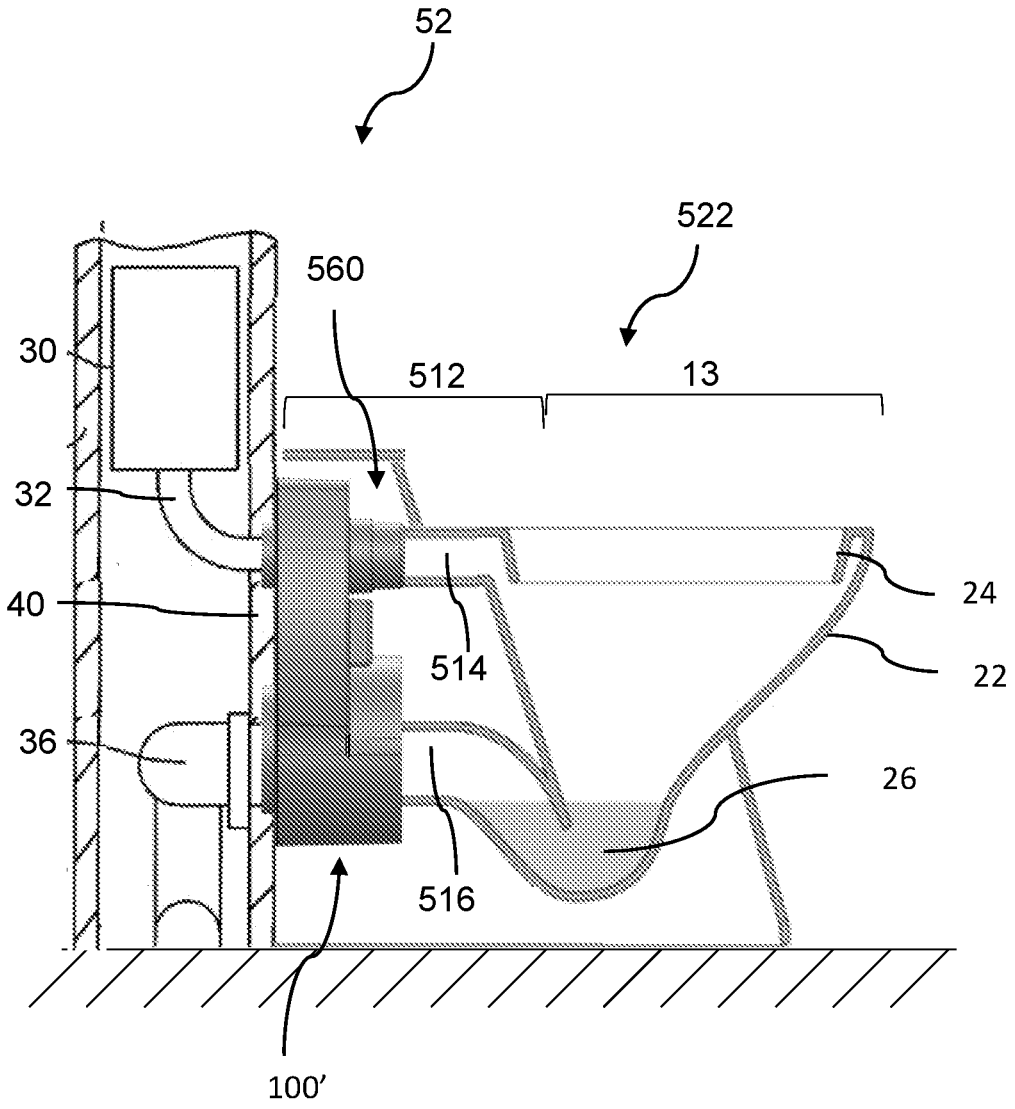
FIG. 9 illustrates a side view of a toilet bowl of a flush toilet system with an air exhaust apparatus integral therewith or integrated therewith, according to a second aspect of the presently disclosed subject matter.

Further reference is directed to FIG. 9 illustrating a flush toilet system 52 differing from the flush toilet system 50 of the previous example in that the air exhaust apparatus 100' is integral with or integrated at the rear portion 512 of the toilet bowl 522, and within a designated space 560 thereof. Otherwise, the air exhaust apparatus 100' is similar to the air exhaust apparatus 100 of the previous example and is interconnecting the rinsing inlet 514 and the waste outlet 516 of flush toilet system 52 with the rinsing liquid tube 32 and the sewage line 36, respectively, as discussed hereinabove. Also, operation of the flush toilet system 52 with the associated air exhaust apparatus 100' is similar to the disclosure hereinabove.

Figure 10A:
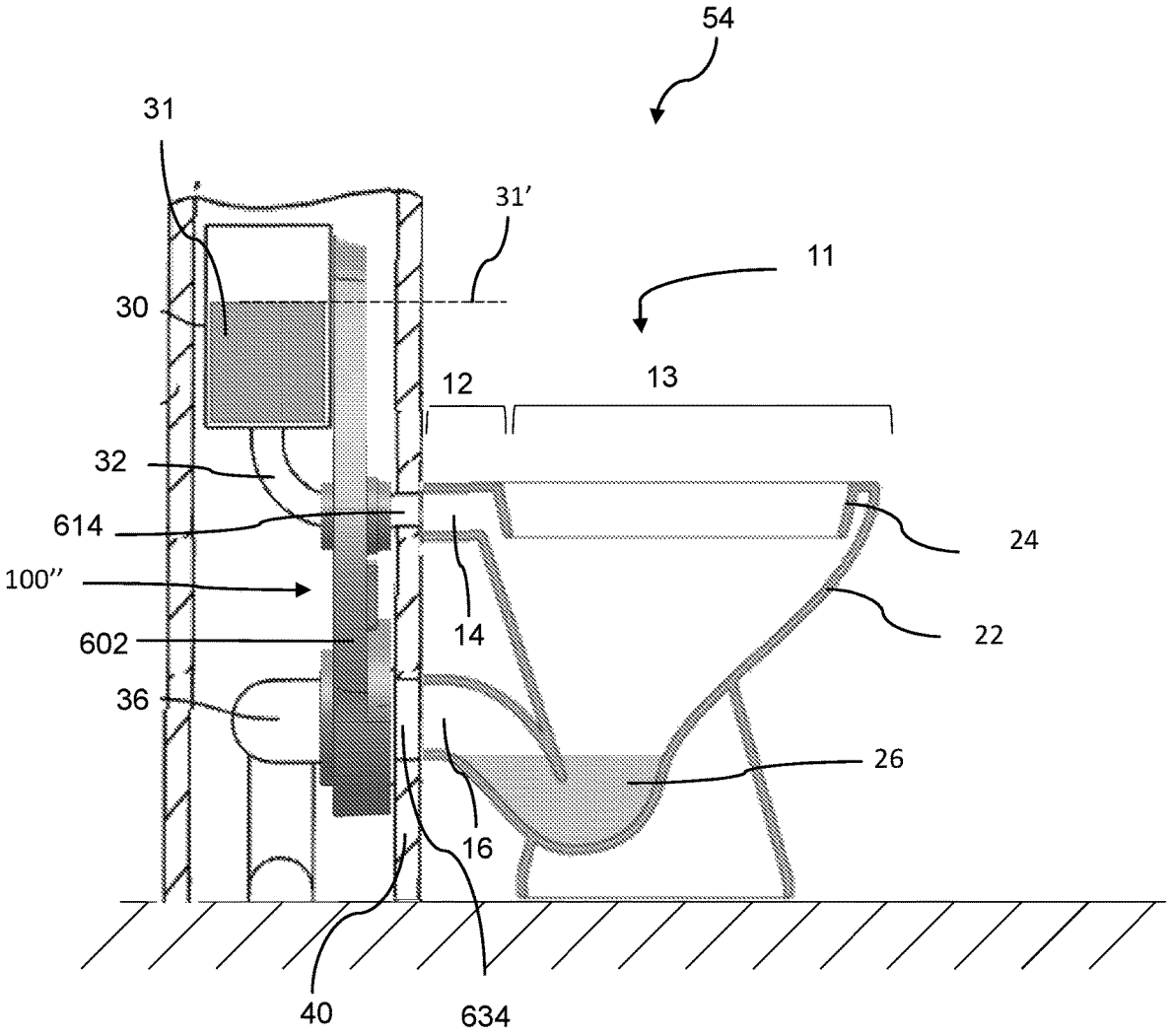
FIG. 10A illustrates a side view of an air exhaust apparatus used in conjunction with the conventional flush toilet system of FIG. 1, according to a third aspect of the presently disclosed subject matter.
Figure 10B:
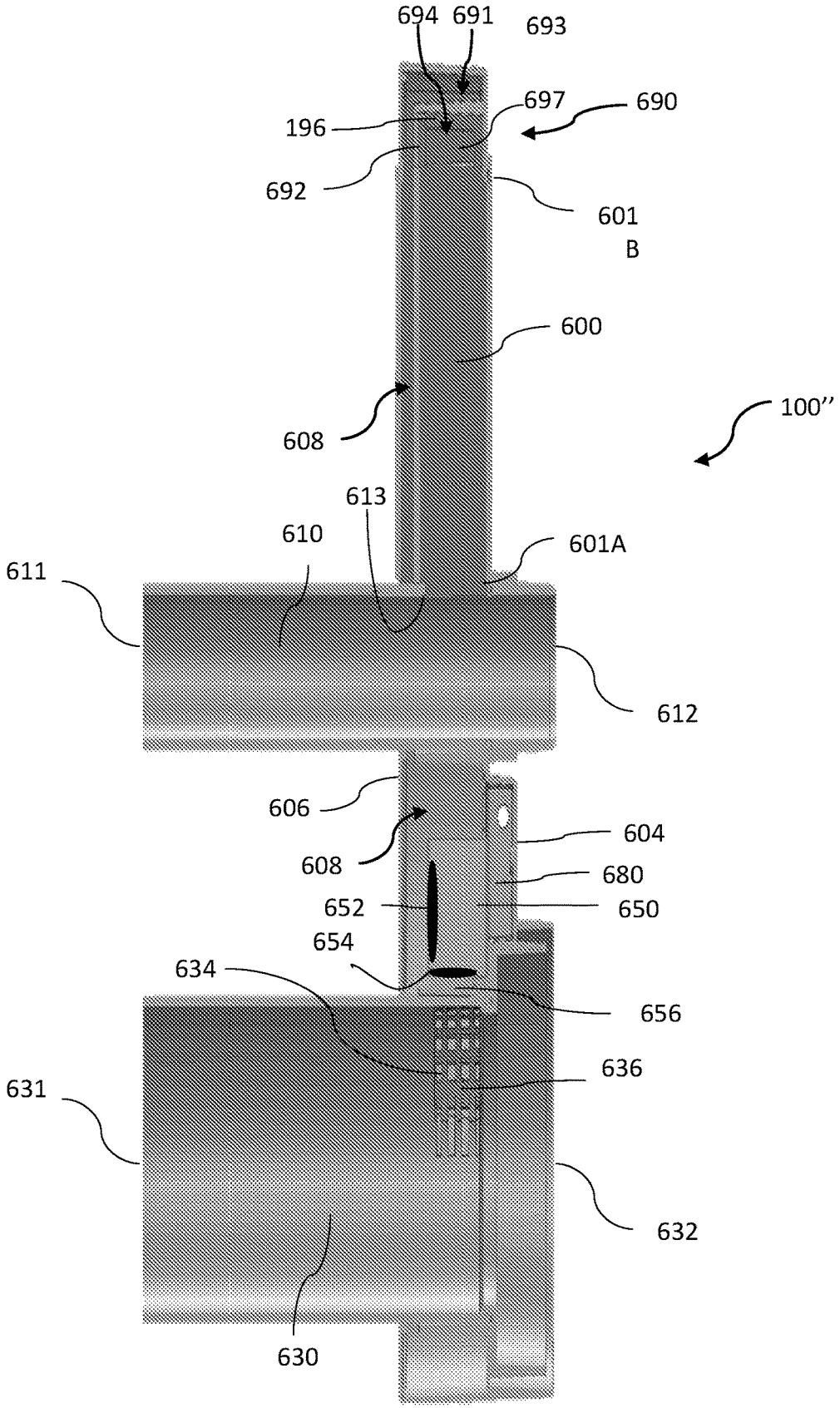
FIG. 10B is a cross-sectional side view along a longitudinal axis of the air exhaust apparatus of FIG. 10A.

Further reference is directed to FIGS. 10A and 10B illustrating an air exhaust apparatus 100" which together with the toilet bowl 11 and the rinsing liquid source 30 defines a flush toilet system 54. Flush toilet system 54 differs from the flush toilet system 50 aforementioned hereinabove in that the air exhaust apparatus 100" is positioned behind the wall 40 and interconnects the rinsing liquid tube 32 of the rinsing liquid source 30 with the sewage line 36. In other examples (not illustrated), the air exhaust apparatus 100" can be integral with or integrated with the rinsing liquid source 30.

As shown, air exhaust apparatus 100" is connected to the rinsing liquid tube 32 at the rear portion 611 of the flushing conduit 610 and also connected to the sewage line 36 at the rear portion of the waste conduit 631. Flush toilet system 54 further comprises an interconnecting flushing tube 614 for connecting the front portion 612 of the flushing conduit 610 with the rinsing inlet 14 and an interconnecting waste tube 634 for connecting the front portion 632 of the waste conduit 630 with the waste outlet 16. In other examples (not illustrated), the front portion 612 of the flushing conduit 610 extends through the wall and can be connected directly to the rinsing inlet 14 and the front portion 632 of the waste conduit 630 can extend through the wall and can be connected directly to the waste outlet.

The air exhaust apparatus 100" also differs from the air exhaust apparatus 100 aforementioned hereinabove in that the liquid flow prevention mechanism is an elevated member 600 in accordance with a second example of the presently disclosed subject matter. The second example of the presently disclosed subject matter can be used in cases that the rinsing liquid source operates via gravity (e.g. flushing tank) and without additional pressure means (e.g. high pressure water tube).

The elevated member 600 is formed as a hollow tube positioned within the housing 602. The elevated member 600 is configured to fluidly connect the suction opening 613 of the flushing conduit 610, which is fluidly connected to a bottom end 601A thereof, with the gas tight valve chamber 694 of the gas flow valve 690, which is fluidly connected to an upper end 601B thereof. The elevated member 600 enables flow communication between the flushing conduit 610 via the suction opening 613 and the space 608 via the gas flow valve 690. Elevated member 600 is configured to extend from the flushing conduit 610 to a height above a water level line 31' of the rinsing liquid 31 inside the rinsing liquid source 30 such that upon flushing action, water are prevented from reaching the gas flow valve 690 at the top of the elevated member 600, since the rinsing liquid source 30 and the elevated member 600 are communicating vessels.

The invention claimed is:

1. An air exhaust apparatus for use in conjunction with a flush toilet system including a rinsing liquid source and a toilet bowl configured with a rinsing inlet and a waste outlet, said air exhaust apparatus comprising:

a housing including a body having an outer surface facing an exterior of the housing and an inner surface facing an interior of the housing, the inner surface defining a gas tight space;

a flushing conduit extending through the housing and comprising a front portion couplable to said rinsing inlet, and a rear portion couplable to the rinsing liquid source; the flushing conduit being configured with a suction opening disposed within the gas tight space, said suction opening being fitted with a liquid flow prevention mechanism configured for preventing rinsing liquid from flowing into the gas tight space during rinsing liquid flow towards the toilet bowl through said flushing conduit;

a waste conduit extending through the housing and comprising a front portion couplable to said waste outlet, and a rear portion couplable to a sewage line; the waste conduit being configured with a gas discharge port disposed within the gas tight space;

a gas propelling unit disposed within the gas tight space and being in flow communication with the gas discharge port and configured to selectively propel gas in direction from the suction opening towards said gas discharge port; and a gas flow valve configured to selectively propel gas in a direction between the suction opening and the gas discharge port when the gas propelling unit is active.

2. The air exhaust apparatus of claim 1, wherein the gas flow valve is further configured to prevent gas flow therethrough when the gas propelling unit is not active.

3. The air exhaust apparatus of claim 1, wherein the gas flow valve is configurable between a flow-permitting position and a flow preventing position, and wherein the gas flow valve is configured to be displaced towards the flow-permitting position when the gas propelling unit is active and be displaced towards the flow-preventing position when the gas propelling unit is not active.

4. The air exhaust apparatus of claim 1, wherein the gas flow valve is a low pressure dependent check valve.

5. The air exhaust apparatus of claim 1, wherein the suction opening is disposed at an upper portion of the flushing conduit.

6. The air exhaust apparatus of claim 1, wherein the gas discharge port is disposed at an upper portion of the waste conduit.

7. The air exhaust apparatus of claim 1, wherein the liquid flow prevention mechanism is a liquid valve and wherein the liquid valve comprises a flap member disposed within the flushing conduit in register with the suction opening.

8. The air exhaust apparatus of claim 7, wherein the flap member is configured with a sealing portion having a surface area larger than a surface area of the suction opening.

9. The air exhaust apparatus of claim 7, wherein the flap member is displaceable between a closed position, at which the sealing portion thereof sealingly covers the suction opening so as to prevent rinsing liquid flow therethrough, and an open position at which the sealing portion is at least partially spaced from the suction opening so as to enable fluid passage therethrough.

10. The air exhaust apparatus of claim 7, wherein the flushing conduit comprises an annular depression along the circumference thereof and rearwards to the suction opening, and wherein the flap member comprises a matching protrusion extending from a rear edge thereof positioned and secured inside the annular depression.

11. The air exhaust apparatus of claim 7, wherein the flap member comprises a truncated conical shape.

12. The air exhaust apparatus of claim 7, wherein the flap member comprises a maintainer element configured to maintain the flap member at the normally open position.

13. The air exhaust apparatus of claim 7, wherein the flushing conduit is configured with a tapering portion disposed within the flushing conduit and in register with the suction opening thereof and wherein the tapering portion tapers toward the front portion of the flushing conduit.

14. The air exhaust apparatus of claim 1, wherein the liquid flow prevention mechanism is an elevated member fluidly connecting the suction opening with the gas flow valve, and wherein the elevated member extends upwards to a height above a water level line of the of the rinsing liquid inside the rinsing liquid source.

15. The air exhaust apparatus of claim 1, wherein both of the flushing conduit and the waste conduit extend normally through the housing, are fixedly positioned relative to each other and have their respective portions extending through the housing in parallel.

16. The air exhaust apparatus of claim 1, wherein the gas propelling unit is disposed between the flushing conduit and the waste conduit.

17. The air exhaust apparatus of claim 1, wherein the flow communication of the gas propelling unit with the gas discharge port is configured such that gases propelled outwards from the gas tight space by the gas propelling unit are obstructed from flowing back to the gas tight space as long as the gas propelling unit is active.

18. The air exhaust apparatus of claim 1, wherein the gas discharge port is fitted with a screening mesh for preventing particle material from entering the housing.

19. A toilet for use in conjunction with a rinsing liquid source, said toilet comprising:

a toilet bowl comprising a rinsing inlet, a waste outlet and a designated space disposed at the rear portion thereof;

an air exhaust apparatus integral with or integrated in said toilet bowl and placed within said designated space, the air exhaust apparatus comprising:

a housing including a body having an outer surface facing an exterior of the housing and an inner surface facing an interior of the housing, the inner surface defining a gas tight space;

a flushing conduit extending through the housing and comprising a front portion couplable to said rinsing inlet, and a rear portion couplable to the rinsing liquid source; the flushing conduit being configured with a suction opening disposed within the gas tight space, said suction opening being fitted with a liquid flow prevention mechanism configured for preventing rinsing liquid from flowing into the gas tight space during rinsing liquid flow towards the toilet bowl through said flushing conduit;

a waste conduit extending through the housing and comprising a front portion coupled to the waste outlet, and a rear portion couplable to a sewage line; the waste conduit being configured with a gas discharge port disposed within the gas tight space;

a gas propelling unit disposed within the gas tight space and being in flow communication with the gas discharge port and configured to selectively propel gas in direction from the suction opening towards said gas discharge port; and a gas flow valve configured to selectively propel gas in a direction between the suction opening and the gas discharge port when the gas propelling unit is active.

20. The toilet of claim 19, wherein the liquid flow prevention mechanism is a liquid valve configured for sealing the suction opening during rinsing liquid flow towards the toilet bowl through said flushing conduit.

* * * * *